US009475624B2

(12) United States Patent
Thomas et al.

(10) Patent No.: US 9,475,624 B2
(45) Date of Patent: Oct. 25, 2016

(54) CHILD-RESISTANT CONTAINER

(71) Applicants: The Yankee Candle Company, Inc., South Deerfield, MA (US); Consultoria Técnica e Representações, Lda., Samora Correia (PT)

(72) Inventors: Cheriyan B. Thomas, Farmington, CT (US); Pedro de Queiroz Vieira, Cascais (PT)

(73) Assignees: The Yankee Candle Company, Inc., South Deerfield, MA (US); Consultoria Técnica e Representações, Lda., Samora Correia (PT)

( * ) Notice: Subject to any disclaimer, the term of this patent is extended or adjusted under 35 U.S.C. 154(b) by 70 days.

(21) Appl. No.: 14/578,645

(22) Filed: Dec. 22, 2014

(65) Prior Publication Data

US 2016/0176591 A1 Jun. 23, 2016

(51) Int. Cl.
*B65D 51/18* (2006.01)
*B65D 50/04* (2006.01)

(52) U.S. Cl.
CPC ..... *B65D 50/046* (2013.01)

(58) Field of Classification Search
CPC ..... B65D 41/30; B65D 41/62
USPC ..... 215/250, 224, 204, 226, 209, 201, 217, 215/218, 228; 220/259.4, 257.1, 257.2, 220/254.7, 259.3, 253, 254.1, 254.8, 254.9, 220/256.1, 259.5, 212
See application file for complete search history.

(56) References Cited

U.S. PATENT DOCUMENTS 4,195,756 A * 4/1980 Campbell ..... B65D 83/24 220/256.1
4,337,869 A * 7/1982 Guinle ..... 215/201
5,127,523 A * 7/1992 Herdlicka ..... 206/370
6,050,436 A * 4/2000 Bennett ..... B65D 41/3428 215/251

FOREIGN PATENT DOCUMENTS

CN 103315509 A 9/2013
WO 2014194684 A1 12/2014

* cited by examiner

*Primary Examiner* — J. Gregory Pickett
*Assistant Examiner* — Allan Stevens
(74) *Attorney, Agent, or Firm* — Husch Blackwell LLP

(57) ABSTRACT

A child-resistant container including a bottle having an annular flange associated therewith, an intermediate member selectively engageable with the bottle and having an annular flange associated therewith, and an outer lid selectively engageable with both the intermediate member and the bottle, the outer lid including a plurality of lower projections for selectively engaging the annular flange of the intermediate member when the outer lid is engaged therewith and for selectively engaging the annular flange of the bottle when the intermediate member is removed from the bottle and the outer lid is engaged with the bottle. Removal of the intermediate member from the bottle allows the plurality of lower projections associated with the outer lid to engage the annular flange associated with the bottle thereby activating the child-resistant locking mechanism.

26 Claims, 5 Drawing Sheets

CHILD-RESISTANT CONTAINER

BACKGROUND OF INVENTION

The present invention relates to a child-resistant container for containing a wide variety of different contents that should not be accessible to children and, more specifically, to a bottle and cap locking mechanism that includes an intermediate seal member for allowing a person to initially open and unseal the bottle and then fully lock the cap onto the bottle to prevent a child from being able to access the contents of the bottle once the intermediate seal member is removed. Such child-resistant containers may frequently be used to contain various materials for household or other uses including functioning as an air freshener container.

The present child-resistant container may be used to contain a wide variety of various materials for household and other uses including use as an air freshener container. For example, the present container may contain odor-neutralizing beads or other fragrance type materials for use in laundry rooms, bathrooms and other rooms and locations throughout a home, office or other locations where a candle may be inconvenient or where an air freshener device is preferred. When used to contain odor-neutralizing beads, the container needs to be child-resistant in order to prevent children from accessing the beads, liquid or other fragrance material found therein, which may be hazardous to children. Other uses for child-resistant containers may include containing medications, food items, or other contents potentially harmful to children.

Oftentimes containers for uses such as those described above include a threaded bottle or jar for engaging corresponding threads on a bottle cap or other closure lid and a removable seal or other member for covering and preserving the contents housed within the bottle or jar. The bottle cap is typically threadedly engaged to the bottle or jar over the removable seal when packaged for sale and requires a user to remove the cap and subsequently remove the seal before use. In these situations, the cap must be removed and re-engaged with the bottle after the seal has been removed. The typical container includes a bottle cap threaded on its inner wall for engaging the corresponding threads on the outer wall of the neck of the bottle.

Many child safety locks exist and are known in the art for securely locking a cap to a bottle so as to prevent children from accessing the contents of the container. However, once the child safety lock is engaged, it is often extremely difficult to re-open the container and, in some mechanisms, it requires breaking the locking mechanism to gain access to the contents of the container or to remove the seal if a user forgot to do so before locking the cap. For example, in some known child-resistant containers, the locking mechanism is associated with both the bottle neck and the cap, and when the cap is fully engaged with the bottle neck, the lock mechanism prevents the cap from being again removed to access the contents of the bottle or the removable seal if the seal has not been removed. This is not a desirable mechanism. Moreover, fully engaging the child safety lock before removing the removable seal or other member as described above renders an air freshener container unusable unless one is able to poke holes through the seal via vent holes in the cap. In other embodiments, the container may be rendered entirely unusable and the contents thereof inaccessible if one fully engages the child safety lock before removing any sort of removable seal, for example, in the case of a container containing medication.

A child lock mechanism is therefore desirable that still allows the bottle cap to be securely locked to the bottle but without engaging the child safety lock, then allows the cap to be removed to provide access to the removable seal or other member for removal thereof if applicable, and then further allows the cap to be reengaged to the bottle neck so as to engage the child safety lock. This solution should be simply designed, inexpensive, and easily manufactured.

SUMMARY OF INVENTION

The present invention relates to a child resistant container and, more particularly, to a child resistant container which allows a user to securely engage an outer lid or cap to a neck portion of the container's bottle without engaging the child safety lock mechanism associated therewith until desired. The child resistant container includes a bottle having a threaded neck portion, an outer lid or cap with a plurality of lower projections for selective mating with both an annular flange associated with the bottle neck and with an annular flange associated with an intermediate member, and an intermediate member that may be placed between the bottle and the outer lid so as to prevent the outer lid from fully engaging the bottle in its child lock safety mode until desired.

When a user purchases the present child resistant container or otherwise obtains the present container prior to use, the intermediate member is threadedly engaged with the bottle neck, and the outer lid is engaged with the intermediate member through a snap fit arrangement thereby preventing the outer lid from engaging the annular flange that circumscribes the neck portion of the bottle. The intermediate member includes a lower annular flange and an upper raised annular flange. When the outer lid is engaged with the intermediate member, a plurality of first projections associated with the outer lid abut the upper raised annular flange of the intermediate member, and a plurality of second projections associated with the outer lid snap over and engage the lower annular flange of the intermediate member. The child safety lock mechanism, in one embodiment, includes the second projections associated with the outer lid or cap and the annular flange associated with the neck of the bottle. This engagement of the second outer lid projections with the lower annular flange of the intermediate member prevents the outer lid from engaging the annular flange associated with the bottle neck until a user is ready to activate the child lock mechanism. Engagement of the second projections associated with the outer lid with the annular flange of the bottle neck effectuates the present child lock mechanism.

It should be noted that engagement of the second projections associated with the outer lid with the lower annular flange of the intermediate member sufficiently secures the outer lid to the intermediate member but still allows a person to disengage such snap fit attachment by simply applying an upward force on the outer lid away from the intermediate member so as to forcibly disengage the two respective members. The size and shape of the lower annular flange associated with the intermediate member and the second projections associated with the outer lid are directly proportional to the amount of force necessary to dislodge the outer lid from the intermediate member. In one embodiment, the upper raised annular flange associated with the intermediate member functions as a stop mechanism so as to allow the second projections associated with the outer lid to engage the lower annular flange of the intermediate member but prevents further downward movement of the outer lid thereby preventing the second projections from engaging the annular flange associated with the bottle neck.

When the intermediate member is properly positioned and threaded onto the bottle neck, this member prevents the contents housed within the bottle from being spilled or otherwise accessed. In the case of an air freshener container, the intermediate member prevents access to the beads or other fragrance material housed within the container and likewise helps to prevent the fragrance material from drying out or losing their fragrance before use. Once the intermediate member is threadedly engaged with the bottle, the outer lid can be snap fitted onto the intermediate member as explained above. This arrangement allows the outer lid to be securely positioned on the bottle with the intermediate member in place for packaging and selling purposes, and further allows a user to easily remove the outer lid to further remove the intermediate member when the contents of the container is ready to be accessed for use. Once the intermediate member is removed from the top of the bottle, the outer lid can now be re-engaged with the bottle neck and the outer lid will now be fully engaged with the annular flange associated with the bottle neck thereby activating the child safety lock mechanism. When the outer lid is reattached to the bottle, the lower or second projections associated with the outer lid are no longer prevented from engaging the annular flange that circumscribes the neck portion of the bottle. As such, the second projections will engage the annular flange of the bottle's neck portion and activate the child safety lock mechanism.

In another embodiment, a differently configured outer lid may be used with the present intermediate member and bottle. The alternative outer lid may include alternatively designed upper projections for abutting the upper raised annular flange of the intermediate member, and alternatively designed lower projections for engaging the lower annular flange of the intermediate member and the annular flange of the bottle neck.

In still another embodiment, a differently configured intermediate member and bottle neck are disclosed allowing the intermediate member to snap fit onto the neck of the bottle as compared to being threadedly engaged.

It is recognized and anticipated that other outer lid and intermediate member configurations as well as other configurations of the various projections and annular flanges associated with the various components of the present child-resistant container can likewise be utilized in conjunction with the present invention in order to accomplish this stated goal.

DESCRIPTION OF THE DRAWINGS

In the accompanying drawings, which form a part of the specification and are to be read in conjunction therewith, in which like reference numerals are used to indicate like or similar parts in the various views.

DETAILED DESCRIPTION OF THE INVENTION

From the foregoing, it will be seen that the present invention is one well adapted to attain all the goals and objectives hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the present invention may be made without departing from the spirit and scope of the present invention, it is also to be understood that all matters herein set forth or shown in the accompanying drawings are to be interpreted as illustrative only and not limiting.

Figure 1:
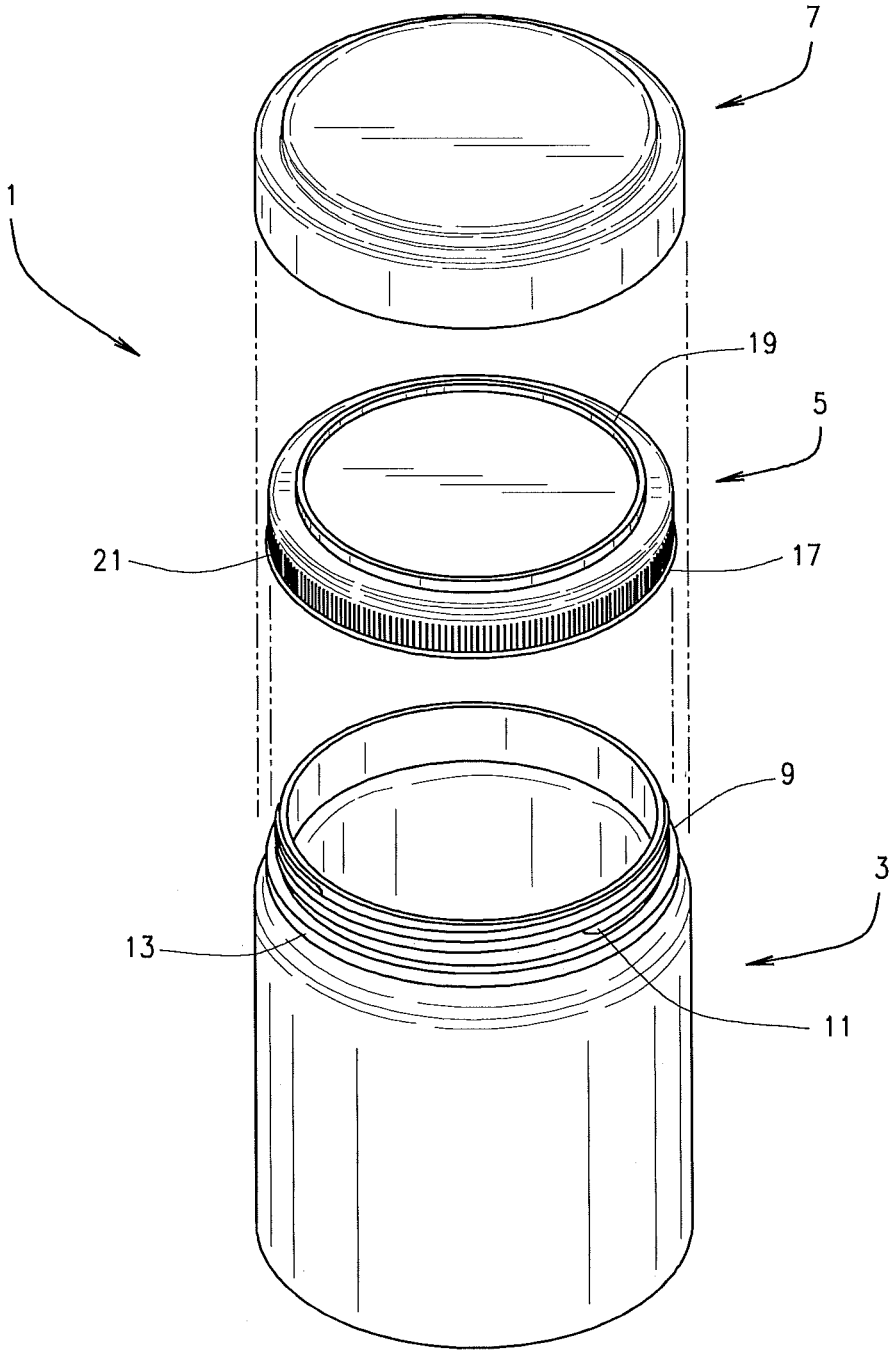
FIG. 1 is an exploded perspective view of a child-resistant container constructed according to the teachings of one embodiment of the present invention.

FIG. 1 illustrates an exploded perspective view of one embodiment of the present child-resistant container 1. Child-resistant container 1 includes a bottle 3 for containing contents that may be unsafe for children, an intermediate member 5, and an outer lid or cap 7. Outer lid 7 is directly engaged with bottle 3 in order to activate the present child safety lock mechanism in a manner described in greater detail below. Intermediate member 5 is threadedly engaged with bottle 3 and functions to seal and protect the contents of bottle 3 and to prevent outer lid 7 from fully engaging bottle 3 and activating the child safety lock mechanism until a user has decided to do so as more fully explained below.

While not illustrated here, a removable seal may also be attached to the opening of bottle 3 when the present container 1 is purchased or otherwise first obtained to keep the contents therein fresh until ready for use or consumption, or any other use for which they may be intended. When a removable seal is present, the seal may further act to prevent the contents therein from spilling.

As illustrated in FIG. 1, bottle 3 includes a neck portion 9 having external threads 11 associated therewith, the threads 11 being of the type well known in the art. An annular flange 13 located below threads 11 circumferentially extends around neck portion 9. Annular flange 13 is positioned and located to engage a plurality of lower projections associated with outer lid 7 when intermediate member 5 is removed as will be hereinafter further explained. In other embodiments, rather than being generally cylindrical, bottle 3 may be shaped or sized differently.

Figure 2:
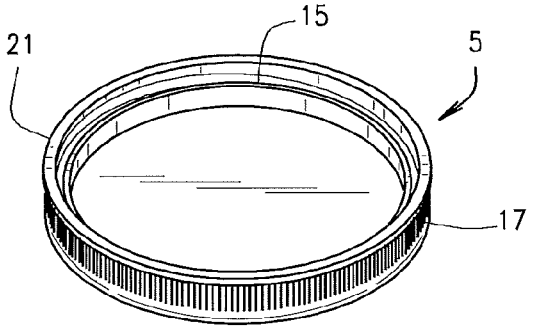
FIG. 2 is a bottom perspective view of an intermediate member of the child-resistant container of FIG. 1.

In FIGS. 1 and 2, intermediate member 5 appears as a lid or cap. In alternative embodiments, intermediate member 5 may be shaped differently, for example, decoratively. Intermediate member 5 includes internal threads 15 for threadedly engaging external threads 11 of bottle neck portion 9. As one skilled in the art may recognize, when intermediate member 5 is threadedly engaged to bottle 3, external threads 11 will receive internal threads 15 and as intermediate member 5 is threaded downwardly onto neck portion 9, threads 11 continue to receive internal threads 15 until intermediate member 5 and neck portion 9 of bottle 3 are selectively engaged. Intermediate member 5 also includes an upper raised annular flange 19 positioned and located around the circumference of the top surface of member 5. Annular flange 19 is positioned and located to mate with a plurality of projections associated with the outer lid 7 for reasons explained below. In addition to upper raised annular flange 19, intermediate member 5 also includes a lower annular flange 21. Lower annular flange 21 is positioned and located to mate with projections associated with outer lid 7 to secure the outer lid 7 to the intermediate member 5 as will be described in greater detail below. When intermediate member 5 is threadedly engaged with neck portion 9 of bottle 3, the lower annular flange 21 lies above annular flange 13 associated with the bottle neck portion 9.

As illustrated in FIGS. 1 and 2, intermediate member 5 may also include a friction grip 17 for allowing a user to better grip intermediate member 5 for threadedly engaging and disengaging intermediate member 5 onto or off of bottle 3. Friction grip 17 may be textured in any manner known or foreseeable in the art that would allow a user to better grip and hold intermediate member 5. In the illustrated embodiment, friction grip 17 extends around the entire circumference of intermediate member 5.

Figure 3:
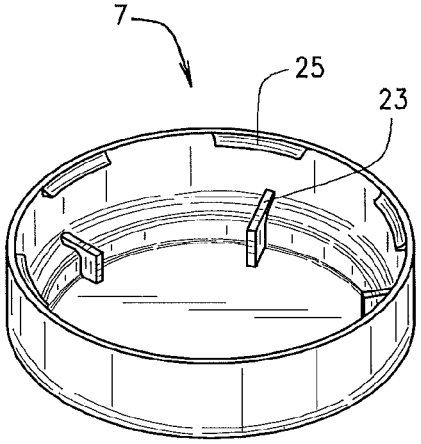
FIG. 3 is a bottom perspective view of an outer lid of the child-resistant container of FIG. 1.
Figure 4:
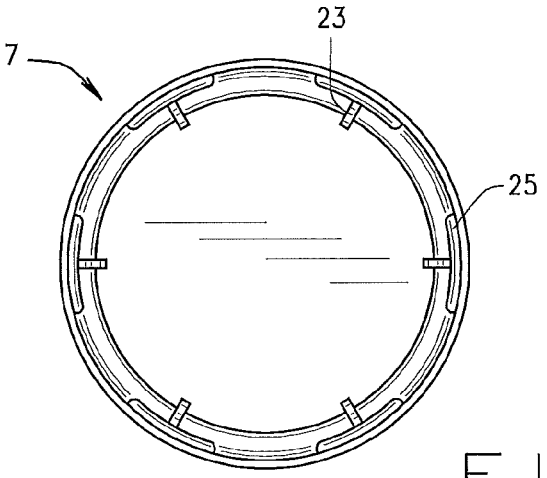
FIG. 4 is a bottom plan form view of the outer lid of FIG. 3.

Outer lid 7 may take on a variety of shapes and sizes, depending on the intended use of bottle 3 and the desired ornamental feature of lid 7. Outer lid 7 is specifically designed such that it may be selectively engaged with intermediate member 5, and when intermediate member 5 has been disengaged from bottle 3 and subsequently discarded, outer lid 7 can be engaged with bottle 3 to activate the child lock mechanism. FIG. 3 illustrates a bottom perspective view of outer lid 7 and FIG. 4 illustrates a bottom plan form view of outer lid 7. As illustrated, outer lid 7 includes a plurality of spaced first or upper projections illustrated as L-shaped projections 23. In addition to the L-shaped projections 23, outer lid 7 also includes a plurality of spaced second or lower projections 25. As will be detailed below when describing FIG. 7, the upper and lower projections of outer lid 7 may be sized and shaped differently as compared to L-shaped projections 23 and spaced projections 25 illustrated in FIGS. 3 and 4 depending upon the size and shape of both outer lid 7 and intermediate member 5.

Figure 5:
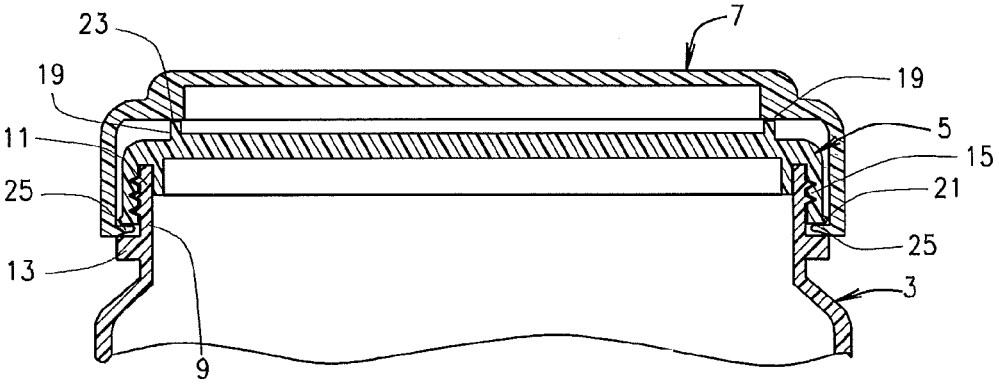
FIG. 5 is a cross-section view of the bottle, intermediate member, and outer lid of the child-resistant container of FIG. 1 when engaged.

FIG. 5 illustrates a cross-section view wherein bottle 3, intermediate member 5, and outer lid 7 have been selectively engaged with one another. As illustrated, internal threads 15 of intermediate member 5 have been threadedly engaged with external threads 11 located on neck portion 9 of bottle 3 so as to position the lower annular flange 21 above annular flange 13 associated with the bottle neck portion 9. Outer lid 7 is engaged with intermediate member 5 in FIG. 5 via a snap fit engagement. As the outer lid 7 is engaged with the intermediate member 5, the L-shaped projections will abut the upper raised annular flange 19 and prevent further downward movement of the outer lid 7. As projections 23 abut flange 19, the lower spaced projections 25 of outer lid 7 likewise overlap and engage the lower annular flange 21 of intermediate member 5 as illustrated in FIG. 5. The projections 23 and 25 as well as the size of the intermediate member 5 and its upper and lower annular flanges 19 and 21 are all coordinated to allow projections 25 to engage annular flange 21 so as to securely hold and engage the outer lid 7 with the intermediate member 5.

As previously stated, when the projections 25 of the outer lid 7 engage and snap over the lower annular flange 21 of the intermediate member 5, such engagement sufficiently secures the outer lid 7 to the intermediate member but still allows a user to disengage the lid 7 from member 5 by simply applying an upward force on the outer lid 7 away from the intermediate member 5 so as to forcibly disengage the two respective members. The size and shape of the lower annular flange 21 associated with the intermediate member 5 and the size and shape of the projections 25 are directly proportional to the amount of force necessary to dislodge the respective members. The upper raised annular flange 19 of intermediate member 5 functions as a stop member so as to allow the projections 25 to engage the annular flange 21 but the abutment of projections 23 with the raised annular flange 19 prevents further downward movement of the outer lid 7 thereby preventing the projections 25 from engaging the annular flange 13 associated with bottle neck portion 9. As illustrated in FIG. 5, when intermediate member 5 is threadedly secured to bottle neck portion 9, and when outer lid 7 is engaged with intermediate member 5, the lower projections 25 will be positioned and located in a gap formed between annular flange 13 and annular flange 21 as illustrated in FIG. 5.

Stated alternatively, when outer lid 7 has been engaged with intermediate member 5, the L-shaped projections 23 abut upper raised annular flange 19 of intermediate member 5 thereby preventing spaced projections 25 from engaging the annular flange 13 of bottle 3. Instead of engaging annular flange 13 of bottle 3, the spaced projections 25 engage the lower annular flange 21 of intermediate member 5. Using the above described mechanism, intermediate member 5 prevents outer lid 7 from engaging bottle 3 and subsequently activating the child lock mechanism.

When a user purchases or otherwise first obtains the present container 1, intermediate member 5 will be properly engaged with bottle 3 and the upper lid 7 will be properly engaged with intermediate member 5. FIG. 5 illustrates this complete engagement. As such, the child lock mechanism of the present invention is not activated since the projections 25 associated with the upper lid 7 are not yet engaged with the annular flange 13 associated with the bottle neck portion 9. Intermediate member 5 may be easily removed from bottle 3 by simply unthreading member 5 from bottle 3. At this point, intermediate member 5 can be discarded if the user is ready to activate the child lock safety mechanism. With intermediate member 5 removed, the spaced projections 25 of outer lid 7 are now free to engage the annular flange 13 of bottle neck portion 9.

Figure 6:
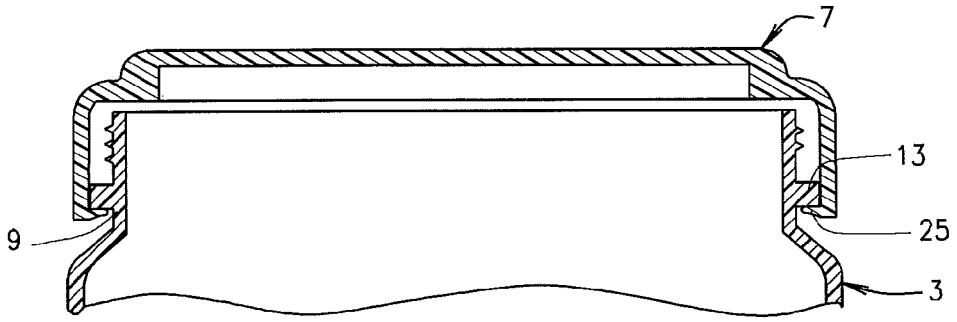
FIG. 6 is a cross-section view of the bottle and outer lid of FIG. 5 when engaged.

FIG. 6 illustrates the engagement of outer lid 7 with bottle neck 9 when the intermediate member 5 has been removed. When lid 7 is re-engaged with bottle neck portion 9, the spaced projections 25 will engage the annular flange 13 via a snap fit engagement thereby activating the child-like mechanism and preventing the contents of the bottle 3 from being accessible by children. When the projections 25 are engaged and overlap annular flange 13, the force required to disengage the projections 25 from annular flange 13 will be too great for a child to accomplish disengagement. In this regard, the size and shape of the projections 25 and the size, shape and width of annular flange 13 are specifically designed to achieve a predetermined force not achievable by children. As such, the outer lid 7 may be removed from bottle neck portion 9 only by applying a sufficiently greater force achievable only by an adult. In an embodiment where the present container 1 is being used as an air freshener container, such as a container housing scented odor-neutralizing beads or other fragrance materials that absorb surrounding odors and diffuse a pleasant fragrance into a surrounding environment, and where the contents of the container need not be accessed once the air freshener container has been activated, disengagement of the outer lid 7 from the bottle 3 may simply be accomplished by applying a sufficiently great force so as to break the projections 25 or the annular flange 13 thereby separating the respective members.

Figure 7:
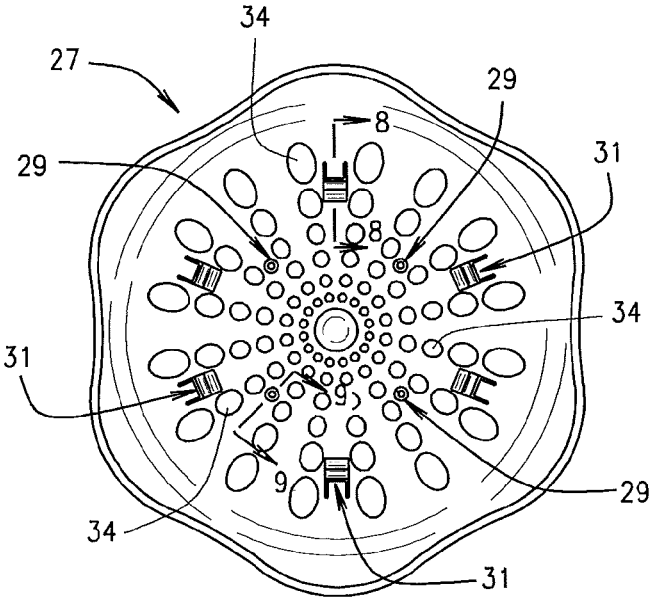
FIG. 7 is a bottom plan form view of another embodiment of an outer lid constructed according to the teachings of the present invention.
Figure 8:
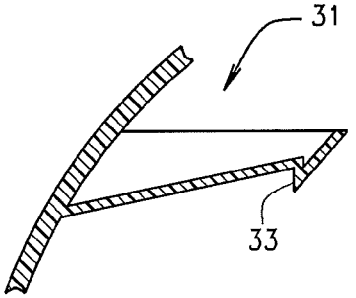
FIG. 8 is a cross-section view taken along line 8-8 of FIG. 7.
Figure 9:
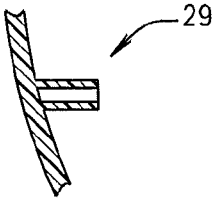
FIG. 9 is a cross-section view taken along line 9-9 of FIG. 7.

FIG. 7 illustrates another embodiment of an outer lid 27 which operates substantially similarly to outer lid 7 described above. Outer lid 27 is decoratively configured and includes a plurality of posts 29 and a plurality of hook projections 31, the posts 29 functioning in a similar manner as the L-shaped projections 23 of outer lid 7 and the hook projections 31 functioning in a similar manner as the projections 25 of outer lid 7. FIG. 8 illustrates a cross-sectional view of a hook projection 31 taken along line 8-8 of FIG. 7 and FIG. 9 illustrates a cross-sectional view of a post 29 taken along line 9-9 of FIG. 7. Posts 29 are again positioned and located to abut the upper raised annular flange 19 of intermediate member 5 when outer lid 27 is engaged with intermediate member 5. Likewise, hook projections 31 are again positioned and located to engage the lower annular flange 21 of intermediate member 5 when outer lid 27 is engaged with intermediate member 5. Hook projection 31 also will engage annular flange 13 of bottle 3 when intermediate member 5 has been removed as previously explained.

As illustrated in FIG. 8, on this particular embodiment, hook projections 31 include a ledge or hook portion 33 which may help projections 31 to better engage both lower annular flange 21 of intermediate member 5 as well as annular flange 13 of bottle neck portion 9. The projection 31 is specifically shaped and designed such that hook portion 33 will slide over or around the side edge portions of both annular flange 21 and annular flange 13 when the outer lid 27 is snap fitted onto either intermediate member 5 or bottle neck portion 9 and the ledge or hook portion 33 will then engage the underneath surface of the respective annular flange 21 or 13. The size and shape of the hook portion 33 and the annular flanges 21 and 13 will again determine the amount of force required to disengage the projections 31 from the respective flanges 21 and 13 as discussed above with reference to outer lid 7. In all other respects, the outer lid 27 functions substantially similarly to outer lid 7.

In the illustrated embodiments of outer lid 7 and outer lid 27, each lid includes six L-shaped projections 23, six spaced projections 25 and six hook projections 31. Outer lid 27 as illustrated includes four posts 29. In other embodiments, there may be greater or fewer L-shaped projections 23, spaced projections 25, posts 29 and/or hook projections 31.

It is also recognized that if the present container 1 is utilized as an air freshener container, the outer lids 7 and 27 will preferably include a plurality of vent holes such as the vent holes 34 illustrated in FIG. 8 for allowing odor-neutralizing beads, or other fragrance materials, within bottle 3 to diffuse the fragrance scent in a desired environment after the intermediate member 5 has been removed. The vent holes 34 can take on a variety of different shapes. Also, there can be any number of vent holes depending upon the fragrance material and the particular application. In any embodiment, the vent holes should be sized and shaped to sufficiently allow the fragrance associated with the odor-neutralizing beads or other fragrance material to be released therefrom.

Figure 10:
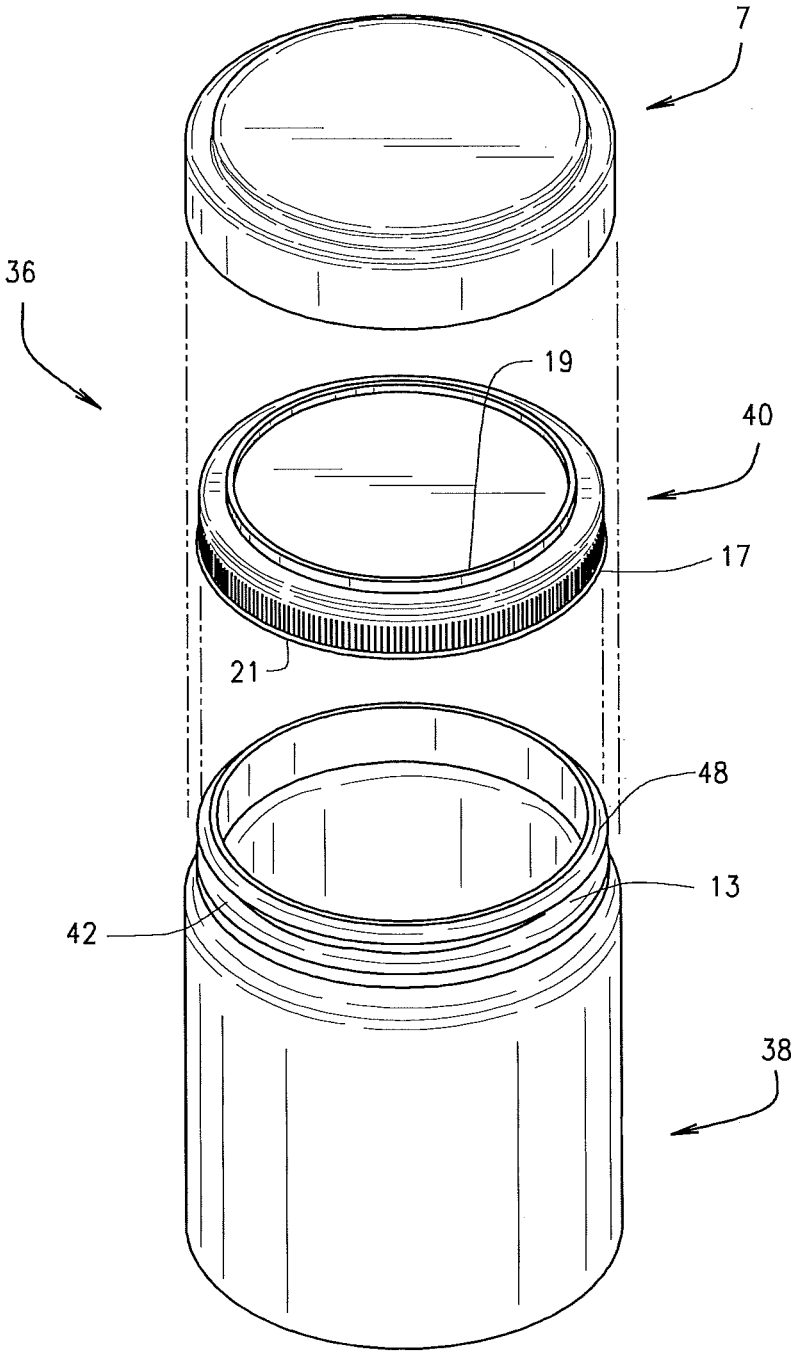
FIG. 10 is an exploded perspective view of another embodiment of a child-resistant container constructed according to the teachings of the present invention.

FIG. 10 illustrates an exploded perspective view of still another embodiment of the present child-resistant container 36. The container 36 includes a bottle 38 for containing a wide variety of different contents, an intermediate member 40, and the same outer lid or cap 7 as previously discussed above. Outer lid 7 is directly engaged with bottle 38 via annular flange 13 and the plurality of spaced lower projections 25 as previously explained with respect to container 1. The structure, function and operation of outer lid 7 is as previously explained above with respect to FIGS. 1, 3 and 4-6.

Figure 11:
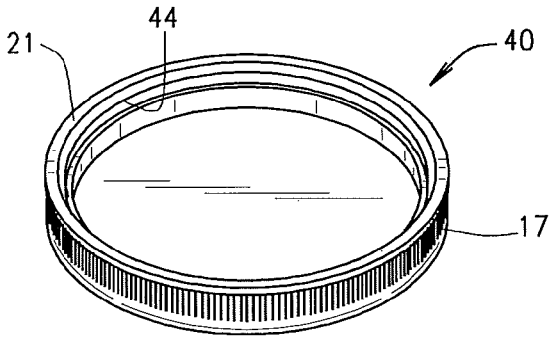
FIG. 11 is a bottom perspective view of the intermediate member of FIG. 10.
Figure 12:
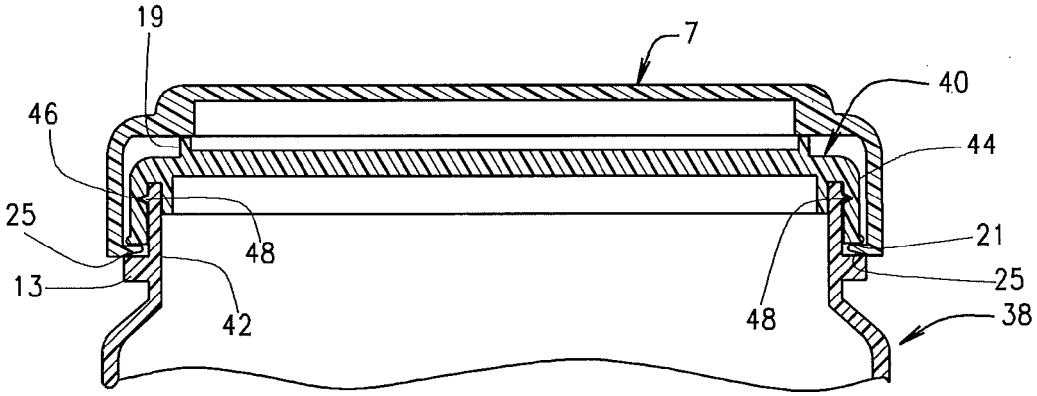
FIG. 12 is a cross-sectional view of the bottle, intermediate member, and outer lid of the child-resistant container of FIG. 10 when engaged.

Intermediate member 40, on the other hand, is structured different from intermediate member 5 and does not threadedly engage the neck portion 42 of bottle 38. Instead, intermediate member 40, as best illustrated in FIGS. 11 and 12, includes an annular flange 44 which forms an annular notch, gap or slot 46 as best illustrated in FIG. 12 which is positioned and located so as to engage an upper annular flange 48 (FIGS. 10, 12 and 13) associated with bottle neck portion 42. Intermediate member 40, like intermediate member 5, functions to seal and protect the contents of bottle 38 and to prevent the outer lid 7 from fully engaging bottle 38 and activating the child safety lock mechanism until a user has decided to do so as explained above.

As best illustrated in FIGS. 10 and 12, the bottle 38 differs from bottle 3 in that it likewise does not include external threads but instead the bottle neck portion 42 includes two annular flanges, an upper annular flange 48 for engaging the notch, gap or slot 46 and the lower annular flange 13 which is likewise positioned and located to engage the plurality of lower projections 25 associated with outer lid 7 as previously explained when intermediate member 40 is removed. In this particular embodiment, the intermediate member 40 snap-fits onto bottle neck portion 42 via annular flange 48 associated with the bottle 38 and the annular notch or gap 46 associated with the intermediate member 40. In all other respects, intermediate member 40 is similar to intermediate member 5 in that it likewise includes an upper raised annular flange 19 for mating with the projections 23 or 29 associated with the outer lids 7 or 27; and it likewise includes a lower annular flange 21 which is positioned and located to mate with the projections 25 or 31 associated with outer lids 7 or 27 to secure the outer lid to the intermediate member as previously explained. When the intermediate member 40 is snap-fitted onto neck portion 42 of bottle 38, the lower annular flange 21 lies above annular flange 13 as previously explained. Intermediate member 40 may likewise include a friction grip 17 for allowing a user to better grip intermediate member 40 as previously explained.

FIG. 12 illustrates a cross-sectional view wherein bottle 38, intermediate member 40, and outer lid 7 have been selectively engaged with one another. As illustrated, outer lid 7 is engaged with intermediate member 40 via a snap-fit engagement as previously explained. As the outer lid 7 is engaged with the intermediate member 40, the projections 23 or 29 will abut the upper raised annular flange 19 and prevent further downward movement of the outer lid 7. As projections 23 or 29 abut flange 19, the lower spaced projections 25 or 31 of outer lids 7 or 27 likewise overlap and engage the lower annular flange 21 of intermediate member 40 as illustrated in FIG. 12. This snap-fit arrangement is substantially identical to the engagement of outer lid 7 or 27 with intermediate member 5 as previously explained above. In all other respects, the bottle 38, intermediate member 40 and outer lid 7 function as previously explained.

Figure 13:
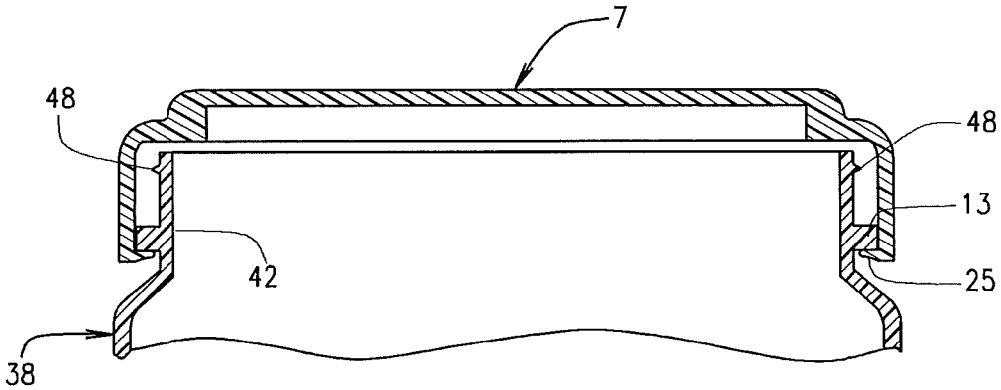
FIG. 13 is a cross-sectional view of the bottle and outer lid of FIG. 12 when engaged.

FIG. 13 illustrates the engagement of the outer lid 7 with the bottle neck portion 42 when the intermediate member 38 has been removed. As previously explained, when lid 7 is re-engaged with bottle neck portion 42, the spaced projections 25 or 31 will engage the annular flange 13 via a snap-fit engagement thereby, activating the child-lock mechanism and preventing the contents of the bottle 38 from being accessible by children as previously explained. Like container 1, the present container 36 can likewise be utilized as an air freshener container as previously explained.

While the present invention described above identifies the child-safety locking members as projections 25 or 31 and annular flange 13, a wide variety of other alternative locking mechanisms are likewise envisioned and available for use in place of projections 25, 31 and annular flange 13. In this regard, other snap fitting arrangements and other locking mechanisms such as a pin and detent or hole arrangement, a hook and eyelet arrangement, or any other locking mechanism known or foreseeable in the art can be utilized in place of projections 25, 31 and annular flange 13 so long as the outer lids 7 and 27 can be sufficiently secured to the intermediate members 5 and 40, and so long as the outer lids 7 and 27 can be securely positioned into engagement with the bottle neck portions 9 and 42 in its child-safety lock position when the intermediate member is removed therefrom.

It is also recognized and anticipated that the present containers 1 and 36 can be utilized as any container regardless of the end use of the container. Still further, although projections 23 and 29 have been referred to as the first projections, and although projections 25 and 31 have been referred to as the second projections associated with outer lids 7 and 27, it is recognized that projections 25 and 31 could be identified as the first projections associated with outer lids 7 and 27 and that projections 23 and 29 could be identified as the second projections associated with outer lids 7 and 27. The order reference to these projections does not impact the scope of the present invention.

The various constructions described above and illustrated in the drawings are presented by way of example only and are not intended to limit the concepts and principles of the present invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A child-resistant container comprising:

a bottle having a rim portion and an annular flange associated therewith, said annular flange being spaced from and located below said rim portion;

an intermediate member selectively engageable with said bottle, said intermediate member having an annular flange associated therewith, the annular flange of said intermediate member being located above the annular flange of said bottle when the intermediate member is engaged with said bottle; and an outer lid engaged with said intermediate member and selectively engageable with said bottle, said outer lid having a plurality of projections for engaging the annular flange associated with said intermediate member and for engaging the annular flange associated with said bottle;

said intermediate member being removable from said bottle and, when removed from said bottle and said outer lid, allowing the projections of said outer lid to engage the annular flange of said bottle when said outer lid is engaged with said bottle.

2. The child-resistant container of claim 1 wherein the outer lid further includes a plurality of second projections.

3. The child-resistant container of claim 2 wherein the intermediate member further includes an upper raised annular flange.

4. The child-resistant container of claim 3 wherein the plurality of second projections of said outer lid abut the upper raised annular flange of said intermediate member when the outer lid is engaged with said intermediate member.

5. The child-resistant container of claim 1 wherein said bottle and said intermediate member include corresponding engageable threads for engaging each other.

6. The child-resistant container of claim 1 wherein said plurality of projections for engaging the respective annular flanges of said bottle and said intermediate members include hook portions.

7. The child-resistant container of claim 2 wherein the plurality of second projections are L-shaped projections.

8. The child-resistant container of claim 2 wherein the plurality of second projections are posts.

9. The child-resistant container of claim 1 wherein said intermediate member includes a friction grip.

10. The child-resistant container of claim 1 wherein said bottle and said intermediate member are engageable to each other via a snap-fit arrangement.

11. A child-resistant container comprising:

a bottle having a neck portion, said neck portion further including an annular flange circumscribing said neck portion;

an intermediate member threadedly engageable with the neck portion of said bottle, said intermediate member including a lower annular flange; and an outer lid engaged with said intermediate member and selectively engageable with the neck portion of said bottle, said outer lid having a plurality of first projections positioned and located for engaging the lower annular flange of said intermediate member when said outer lid is engaged with said intermediate member;

said intermediate member being removable from said bottle neck portion, and when removed from said bottle and said outer lid, said plurality of first projections of said outer lid being engageable with the annular flange of said bottle neck portion when said outer lid is engaged with said bottle neck portion.

12. The child-resistant container of claim 11 wherein said outer lid further includes a plurality of second projections.

13. The child-resistant container of claim 12 wherein said intermediate member further includes an upper raised annular flange.

14. The child-resistant container of claim 13 wherein said plurality of second projections of said outer lid abut the upper raised annular flange of said intermediate member when said outer lid is engaged with said intermediate member.

15. A container comprising:

a bottle having a neck portion, said neck portion including an annular flange;

an inlet mediate member selectively engageable with the neck portion of said bottle, said intermediate member including a first lower annular flange and a second upper raised annular flange; and an outer lid selectively engageable with both said intermediate member and with said bottle neck portion, said outer lid including a plurality of first projections positioned and located for engaging the first lower annular flange of said intermediate member when said outer lid is engaged with said intermediate member, and a plurality of second projections positioned and located for abutting said second upper raised annular flange member of said intermediate member when said outer lid is engaged with said intermediate member;

said intermediate member being removable from said bottle neck portion, and when so removed, the plurality of first projections associated with said outer lid being engageable with the annular flange associated with said bottle neck portion when said outer lid is engaged directly with said bottle neck portion.

16. The container of claim 15 wherein said plurality of first projections associated with said outer lid, include hook portions.

17. The container of claim 15 wherein said plurality of second projections associated with said outer lid are L-shaped projections.

18. The container of claim 15 wherein said plurality of second projections associated with said outer lid are posts.

19. The container of claim 15 wherein said intermediate member includes a friction grip.

20. The container of claim 15 wherein said outer lid is decoratively configured.

21. The container of claim 15 wherein said plurality of second projections associated with said outer lid are shaped and dimensioned so as to prevent the plurality of first projections associated with said outer lid from engaging the annular flange of said bottle neck portion when said outer lid is selectively engaged with said intermediate member and said intermediate member is engaged with said bottle neck portion.

22. The container of claim 15 wherein said bottle and said intermediate member include corresponding engageable threads for engaging each other.

23. The container of claim 15 wherein said bottle and said intermediate member engage each other via a snap-fit arrangement.

24. The container of claim 23 wherein said bottle neck portion includes a second annular flange, and wherein said intermediate member includes a gap, said gap being positioned and located so as to engage said second annular flange associated with said bottle neck portion when said intermediate member is selectively engaged with said bottle neck portion.

25. A child-resistant container comprising:

a bottle having an annular flange associated therewith;

an intermediate member selectively engageable with said bottle, said intermediate member having an annular flange associated therewith;

said bottle and said intermediate member including corresponding engageable threads for engaging each other; and an outer lid engaged with said intermediate member and selectively engageable with said bottle, said outer lid having a plurality of projections for engaging the annular flange associated with said intermediate member when said outer lid is engaged with said intermediate member;

said intermediate member being removable from said bottle and, when removed from said bottle and said outer lid, allowing the projections of said outer lid to engage the annular flange of said bottle when said outer lid is engaged with said bottle.

26. A child-resistant container comprising:

a bottle having an annular flange associated therewith;

an intermediate member selectively engageable with said bottle, said intermediate member having a first lower annular flange and a second upper raised annular flange associated therewith; and an outer lid selectively engageable with said intermediate member and with said bottle, said outer lid having a plurality of first projections for engaging the first lower annular flange associated with said intermediate member and for engaging the annular flange associated with said bottle and a plurality of second projections for abutting the second upper raised annular flange associated with said intermediate member; and said intermediate member being removable from said bottle and, when removed, allowing the first projections of said outer lid to engage the annular flange of said bottle when said outer lid is engaged with said bottle.

* * * * *